US011146886B2

(12) United States Patent
Schlittmeier

(10) Patent No.: US 11,146,886 B2
(45) Date of Patent: Oct. 12, 2021

(54) LOUDSPEAKER BOX AND COLUMN LOUDSPEAKER BOX

(71) Applicant: Robert Bosch GmbH, Stuttgart (DE)

(72) Inventor: Thomas Schlittmeier, Altdorf (DE)

(73) Assignee: Robert Bosch GmbH, Stuttgart (DE)

( * ) Notice: Subject to any disclaimer, the term of this patent is extended or adjusted under 35 U.S.C. 154(b) by 8 days.

(21) Appl. No.: 16/618,498

(22) PCT Filed: Feb. 23, 2018

(86) PCT No.: PCT/EP2018/054460
§ 371 (c)(1),
(2) Date: Dec. 2, 2019

(87) PCT Pub. No.: WO2018/219505
PCT Pub. Date: Dec. 6, 2018

(65) Prior Publication Data

US 2021/0152928 A1 May 20, 2021

(30) Foreign Application Priority Data

May 31, 2017 (DE) ..... 10 2017 209 193.2

(51) Int. Cl.
*H04R 1/34* (2006.01)

(52) U.S. Cl.
CPC ..... *H04R 1/345* (2013.01); *H04R 2201/02* (2013.01)

(58) Field of Classification Search
CPC .... H04R 25/40; H04R 25/405; H04R 25/407; H04R 25/50; H04R 25/505; H04R 25/55; H04R 25/554; H04R 25/558; H04R 2225/41; H04R 2225/55; H04R 2225/61; H04R 2430/20; H04R 2430/21;
(Continued)

(56) References Cited

U.S. PATENT DOCUMENTS 4,776,428 A * 10/1988 Belisle ..... G10K 11/025 181/152
6,112,847 A 9/2000 Lehman
(Continued)

FOREIGN PATENT DOCUMENTS

DE 202008017790 5/2010
EP 1178702 2/2002

OTHER PUBLICATIONS

International Search Report for Application No. PCT/EP2018/054460 dated Jun. 1, 2018 (English Translation, 3 pages).

*Primary Examiner* — Walter F Briney, III
(74) *Attorney, Agent, or Firm* — Michael Best & Friedrich LLP

(57) ABSTRACT

The invention relates to a loudspeaker box (12) comprising a housing (20), a loudspeaker (22) arranged in the housing (20) for generating sound, and a sound-guide device (14), wherein the sound-guide device (14) is arranged in front of the loudspeaker (22) in a sound propagation direction (25), wherein the sound-guide device (14) is configured in such a way that the sound-guide device (14) guides the sound generated by the loudspeaker (22) to a front slot (30) arranged on a front side (27) of the sound-guide device (14) for the purposes of sound radiation. The invention also relates to a column loudspeaker box (10) comprising at least two loudspeaker boxes (12) arranged above one another.

26 Claims, 4 Drawing Sheets

(58) Field of Classification Search
CPC ..... H04R 2430/23; H04R 2430/25; H04R 2460/07; H04R 3/005; H04R 1/32; H04R 1/326; H04R 1/40; H04R 1/406
See application file for complete search history.

(56) References Cited

U.S. PATENT DOCUMENTS

| | | | | |
|---|---|---|---|---|
| 7,624,839 | B1 * | 12/2009 | Graber | H04R 1/22 181/145 |
| 2003/0188920 | A1 | 10/2003 | Brawley | |
| 2005/0265570 | A1 * | 12/2005 | Isotalo | H04R 1/30 381/337 |
| 2015/0271591 | A1 | 9/2015 | Monroe | |
| 2016/0105744 | A1 * | 4/2016 | Voishvillo | H04R 1/30 381/343 |
| 2016/0212523 | A1 * | 7/2016 | Spillmann | H04R 1/345 |
| 2018/0184208 | A1 * | 6/2018 | O'Brien | H04R 7/26 |

* cited by examiner

LOUDSPEAKER BOX AND COLUMN LOUDSPEAKER BOX

BACKGROUND OF THE INVENTION

The invention relates to a loudspeaker box comprising a housing, a loudspeaker arranged in the housing for generating sound and a sound-guiding device, wherein the sound-guiding device is arranged in front of the loudspeaker in a sound propagation direction. The invention also relates to a column loudspeaker box.

The utility model DE 20 2008 017 790 U1 discloses a loudspeaker arrangement comprising a number of loudspeakers, wherein a high-range loudspeaker has for the purpose of guiding the sound a further horn adjoining its sound exit opening.

SUMMARY OF THE INVENTION

The loudspeaker box according to the invention comprising a housing, a loudspeaker arranged in the housing for generating sound and a sound-guiding device, wherein the sound-guiding device is arranged in front of the loudspeaker in a sound propagation direction, wherein the sound-guiding device is configured in such a way that the sound-guiding device directs the sound generated by the loudspeaker to a front slot arranged on a front side of the sound-guiding device for the purpose of sound radiation, has the advantage that the sound propagation takes place uniformly in a direction of propagation perpendicular to the slot in that an almost ideal cylindrical wavefront is produced, contributing to providing an audible range optimally with sound and sending as little acoustic energy as possible outside this audible range into the room.

The vertical arrangement of the front slot achieves the advantage that the sound propagation takes place uniformly in the horizontal direction in the form of an almost ideal cylindrical wavefront. This process is based on the observation that, in the transverse direction in relation to the loudspeaker box, that is to say in the horizontal direction, the emitted sound waves are deflected outward by diffraction effects at the front slot. This contributes to broad radiation. It is particularly advantageous here that the front slot is divided into chambers by front longitudinal and/or transverse members, since this design forms the basis for allowing the sound transit times from the rear side to the front side of the sound-guiding device to be chosen differently for each chamber, so that altogether an in-phase sound radiation is made possible. This contributes to the wavefront also being uniform in the vertical direction. It is particularly advantageous here if the front openings of the chambers are coplanar, and are consequently arranged in one plane as an acoustic baffle. Preferably, the vertical slot is in this case divided into columns and/or rows of chambers. It is particularly preferred that the front slot has only a single column with a number of n rows. In a variant, the front slot has m columns with n rows.

It is particularly advantageous that the front slot has a width of between 10 mm and 30 mm, preferably between 15 mm and 25 mm, in particular 20 mm. The advantage is that, as a result of this width, the generated wavefront in the region of the human audible range, between approximately 20 Hz and 20 kHz, in particular in the range between 200 Hz and 12.5 kHz, corresponds to the optimum cylindrical wavefront aimed for.

In an advantageous way, the loudspeaker is formed as a cone loudspeaker, in particular as a cone mid-range and/or cone broadband loudspeaker. Preferably, the loudspeaker has a loudspeaker diaphragm. Preferably, the loudspeaker is formed as a moving coil loudspeaker, a coil oscillating in the field of a magnet and, as a result, the loudspeaker diaphragm moving to generate sound. The advantages of the cone loudspeakers are based on the observation that, depending on the diameter, cone loudspeakers provide increasing concentration toward the higher frequencies. This consequently contributes to improved horizontal sound radiation in these frequency ranges with cone loudspeakers.

It is particularly advantageous that the rear surface of the rear side of the sound-guiding device facing the loudspeaker is formed at least in certain regions in the form of a negative impression of the loudspeaker and/or of the loudspeaker diaphragm. This has the advantage that the distance between the loudspeaker and/or the loudspeaker diaphragm and the surface of the rear side of the sound-guiding device is almost uniformly the same. This contributes to improved coupling of the sound generated into the channels. It is particularly advantageous that the rear surface of the rear side of the sound-guiding device facing the loudspeaker is formed in the form of a negative impression of the loudspeaker and/or of the loudspeaker diaphragm apart from the region of the rear slots. It is particularly advantageous here if the rear surface of the rear side of the sound-guiding device facing the loudspeaker has at least in the region of the loudspeaker diaphragm substantially a distance of less than 10 mm, in particular less than 5 mm, in particular less than 2 mm, from the loudspeaker diaphragm. With preference, the distance is chosen such that, when there is maximum deflection, the loudspeaker diaphragm does not any longer quite come up against or come into contact with the rear side of the sound-guiding device. With preference, the distance is 5 mm.

It is particularly advantageous that the sound-guiding device has a channel between the rear slot and one of the chambers of the front slot, wherein the channel has a predetermined sound transit time. It is in this case provided that the sound generated by the loudspeaker is directed into rear openings of the channels. In a preferred embodiment, all of the channels have the same predetermined sound transit times. This leads to a loudspeaker box that is of a simple construction and is consequently inexpensive. With preference, the predetermined sound transit time of a sound introduced into the channel until when the sound is radiated out of the chamber is different for at least two channels. It is particularly advantageous here if the predetermined sound transit times of the channels are chosen such that the sound is radiated out of the chambers of the front slot substantially in-phase. This contributes to a homogeneous sound field. With preference, the sound transit times of the channels are set by the geometrical length of the channels. Preferably, the geometrical length is varied, and consequently set, by inserting deflecting geometries within the channels. Preferably, the predetermined sound transit times are from 0.01 ms to 0.02 ms, in particular from 0.03 ms to 0.09 ms.

Advantageous is a loudspeaker box in which at least one damping element is arranged between the rear side of the sound-guiding device and the housing and/or the loudspeaker, since as a result standing sound waves between the rear side of the sound-guiding device and the loudspeaker are prevented or attenuated. Overall, this contributes to a homogeneous sound field. With preference, the damping element is a sound-absorbing material, in particular a sound-absorbing foam. Preferably, two damping elements are arranged.

Also advantageous is a loudspeaker box in which at least one edge of the front side of the sound-guiding device is rounded with a radius of from 5 mm to 30 mm, in particular with a radius of from 10 mm to 20 mm. This is based on the observation that sharp edges on the outside of loudspeaker boxes can lead to inhomogeneous sound fields due to diffraction effects. This consequently contributes to a homogeneous sound field. It is particularly advantageous here if at least one vertical edge of the front side of the sound-guiding device has a radius, since this contributes to a homogeneous sound field in the horizontal direction.

Particularly advantageous is a column loudspeaker box comprising at least two loudspeaker boxes described above arranged one on top of the other. Column loudspeaker boxes have the advantage that they have a slender, unobtrusive appearance. Furthermore, column loudspeaker boxes have the advantage that the sound distribution can be optimally tuned to the usual auditory sensation areas. Advantageous here in particular is a column loudspeaker box in which the surface normals of the front sides of the sound-guiding devices of two loudspeaker boxes arranged directly one on top of the other form an angle of between 0° and 10°, preferably an angle of between 0° and 5°. With preference, the angle is 1°. This likewise contributes to a homogeneous sound field. By the shaping of the acoustic baffle, curved in this way, in the direction of the arrangement of the loudspeaker boxes vertically in line, the advantage is achieved that a width of the sound radiation that is adapted to the requirements is achieved. The broad sound radiation is achieved by the respective surface normal of the front side pointing in a different direction as a result of the curved shaping of the loudspeaker boxes arranged in line. These directional vectors of the surface normals form a plane. The sound transit time of the individual loudspeaker boxes to any desired spatial point within this plane differs in length. As a result, a corresponding interference pattern forms. Preferably, the angle between the loudspeaker boxes is chosen so as to obtain a predetermined interference pattern, with which a broader area of the main and/or side lobes is acoustically irradiated than would be the case with a non-angled arrangement.

Further advantages are obtained from the following description of exemplary embodiments with reference to the figures and from the dependent claims.

BRIEF DESCRIPTION OF THE DRAWINGS

Exemplary embodiments of the invention are explained in more detail in the following description and are represented in the drawings on the basis of several figures, in which.

DETAILED DESCRIPTION

A loudspeaker box is described below, comprising a housing, a loudspeaker arranged in the housing for generating sound and a sound-guiding device, wherein the sound-guiding device is arranged in front of the loudspeaker in a sound propagation direction, wherein the sound-guiding device is configured in such a way that the sound-guiding device directs the sound generated by the loudspeaker to a front slot arranged on a front side of the sound-guiding device for the purpose of sound radiation. Also described is a column loudspeaker box comprising at least two loudspeaker boxes arranged one on top of the other.

Figure 1:
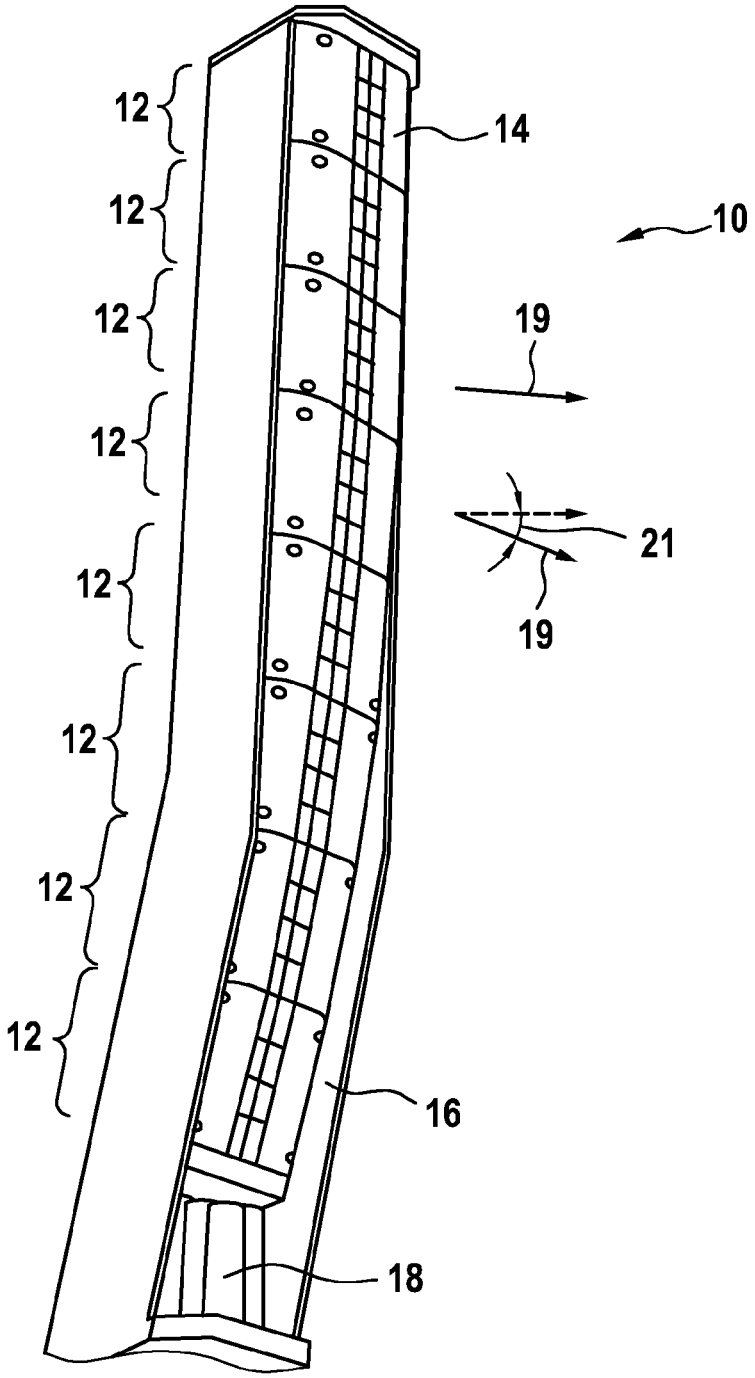
FIG. 1 shows a column loudspeaker box.

FIG. 1 shows a column loudspeaker box 10 with a plurality of identical loudspeaker boxes 12 arranged one on top of the other. The loudspeaker boxes 12 arranged one on top of the other have in each case a sound-guiding attachment as a sound-guiding device 14. In this case, the loudspeaker boxes 12 arranged one on top of the other are arranged in a housing 16 of the column loudspeaker box 10. At the lower end of the column loudspeaker box 10 there is a mounting 18, which is configured to attach the column loudspeaker box 10 on a stand that is not shown. FIG. 1 also shows by way of example two surface normals 19 of the sound-guiding devices 14 of two loudspeaker boxes 12 arranged directly one on top of the other, here specifically the third and fourth loudspeaker boxes 12 from the top. The two surface normals 19 in this case form an angle 21 in the perpendicular direction. In the preferred exemplary embodiment, the angle 21 is 1°.

Figure 2:
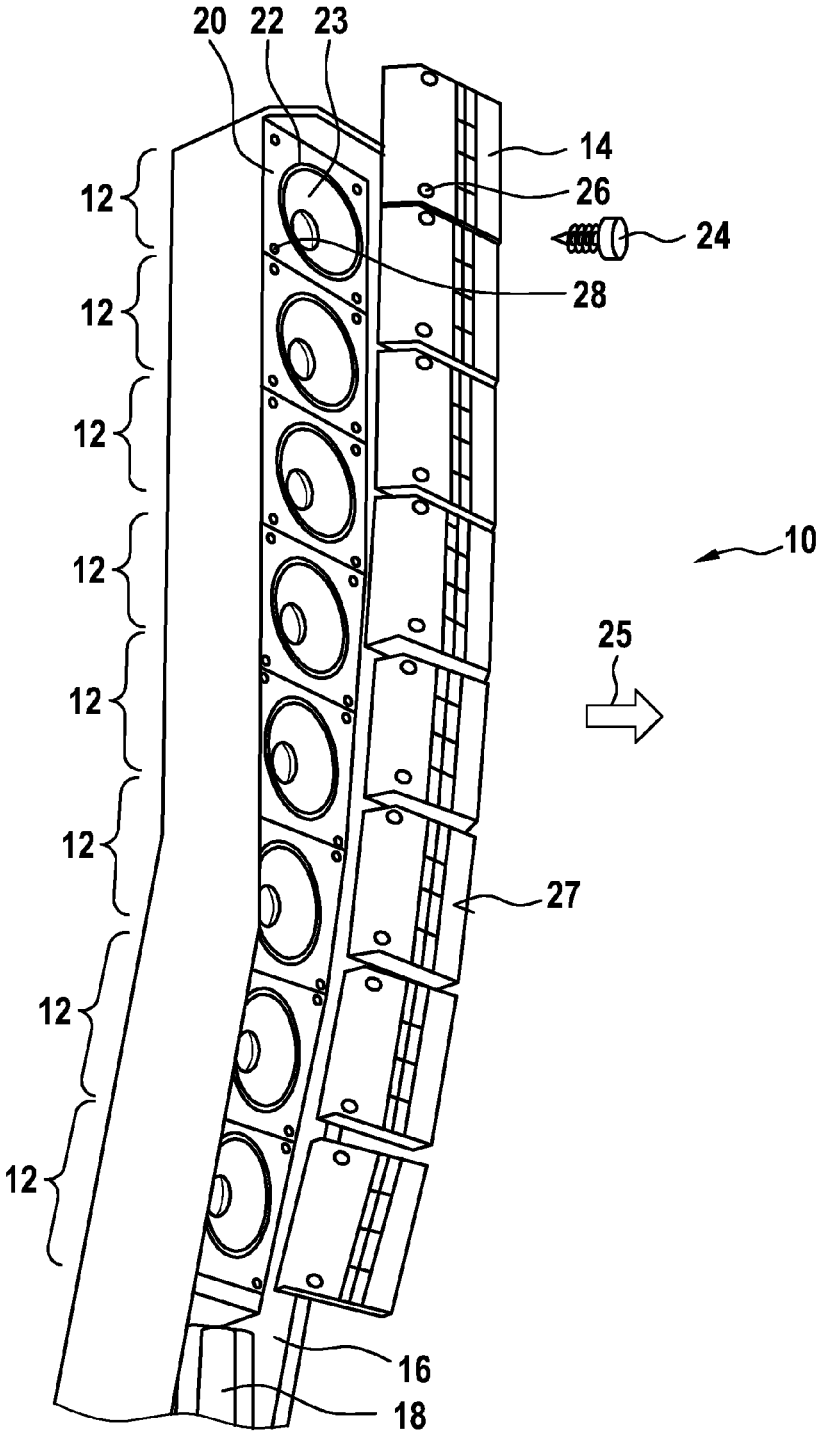
FIG. 2 shows a column loudspeaker box in an exploded representation.

FIG. 2 shows the column loudspeaker box 10 of FIG. 1 in an exploded representation. The column loudspeaker box 10 has a plurality of identical loudspeaker boxes 12 arranged one on top of the other. The loudspeaker boxes 12 are arranged in a housing 16 of the column loudspeaker box 10. FIG. 2 likewise shows a mounting 18, which is configured to attach the column loudspeaker box 10 on a stand. Each of the loudspeaker boxes 12 comprises a housing 20 of the loudspeaker box 12 and a loudspeaker 22 arranged in the housing 20. In the preferred exemplary embodiment, the loudspeaker 22 is a cone loudspeaker with a loudspeaker diaphragm 23. Preferably, the loudspeaker 22 is formed as a mid-range loudspeaker and/or as a broadband loudspeaker. Furthermore, each of the loudspeaker boxes 12 comprises a sound-guiding device 14 formed as a sound-guiding attachment. In the preferred exemplary embodiment, all of the sound-guiding devices 14 of the loudspeaker boxes 12 arranged one on top of the other are formed identically. The sound-guiding devices 14 are formed substantially square on the front side and have in the corners on the front side 27 four clearances 26, which are formed for the purpose of fastening the sound-guiding device 14 on the housing 20 of the loudspeaker box 12 by means of four screws 24, wherein the screws 24 engage in receptacles in the housing 20 of the loudspeaker box 12 that are formed with external threads. In the preferred exemplary embodiment, the sound-guiding device 14 has a width of 100 mm and a height of 90 mm. FIG. 2 also symbolically shows by an arrow the sound propagation direction 25 of the loudspeaker box 12 of the column loudspeaker box 10.

Figure 3:
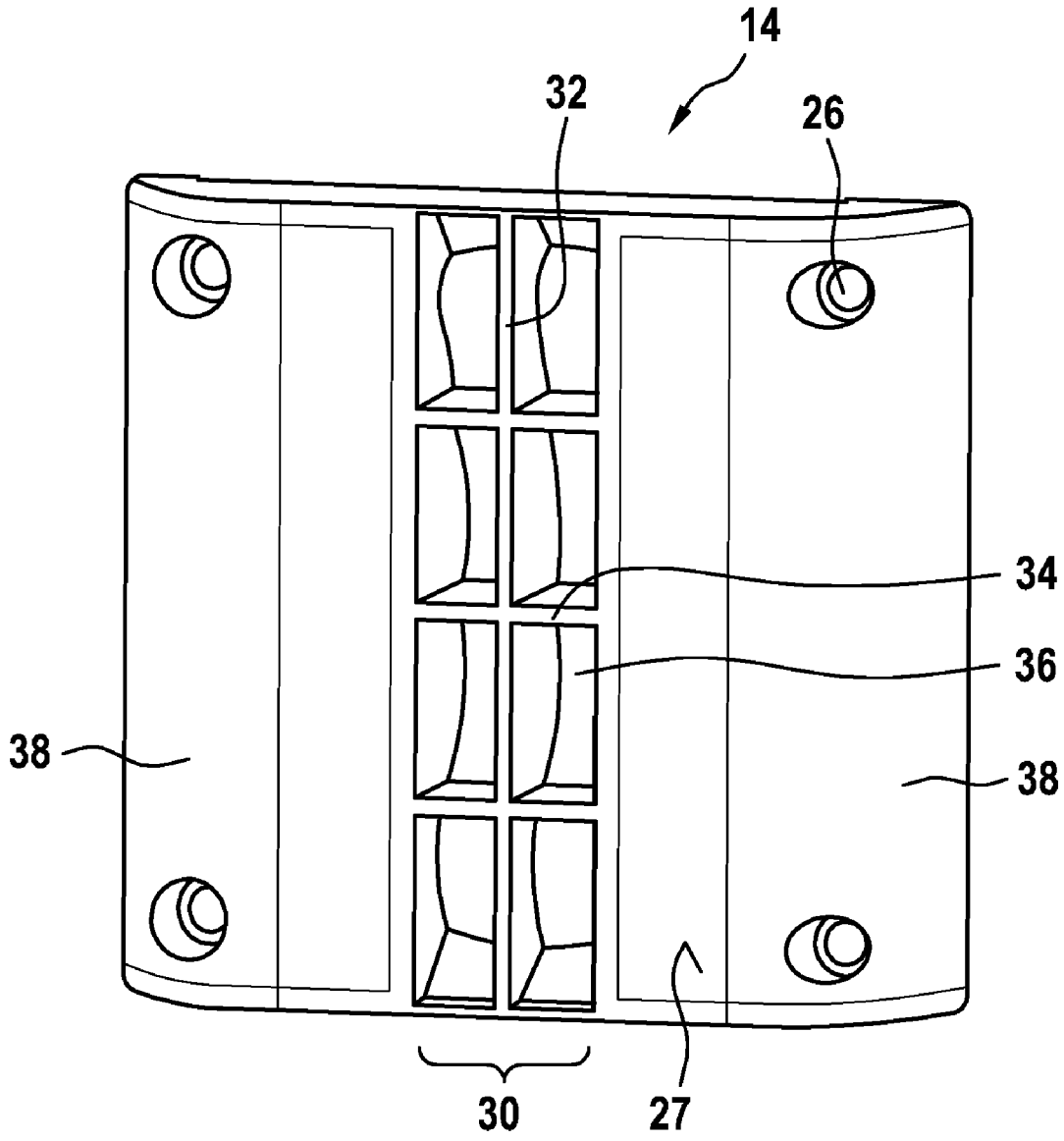
FIG. 3 shows a front side of a sound-guiding device.

FIG. 3 shows a front side 27 of the sound-guiding device 14. The sound-guiding device 14 has on the front side 27 a front slot 30. In the preferred exemplary embodiment, the front slot 30 is arranged vertically and centrally in the sound-guiding device 14. The front slot 30 is divided into individual chambers 36 by horizontal, front transverse members 34 and a vertical, front longitudinal member 32. In the preferred exemplary embodiment, the sound-guiding device has eight chambers 36, which are arranged in two columns and four rows. The sound-guiding device 14 is configured in such a way that the sound-guiding device 14 directs the sound generated by the loudspeaker arranged behind the sound-guiding device 14 to the front slot 30 arranged on a front side 27 of the sound-guiding device 14 for the purpose of sound radiation. In the preferred exemplary embodiment, the front slot 30 has a width over the two horizontal chambers 36 of 20 mm. FIG. 3 also shows four clearances 26 with holes arranged in the corners. The clearances 26 are formed for the purpose of fastening the sound-guiding device 14 on the housing of the loudspeaker box by means of screws. The two vertical edges 38 on the front side 27 of the sound-guiding device 14 have in the preferred exemplary embodiment a radius of 15 mm.

Figure 4:
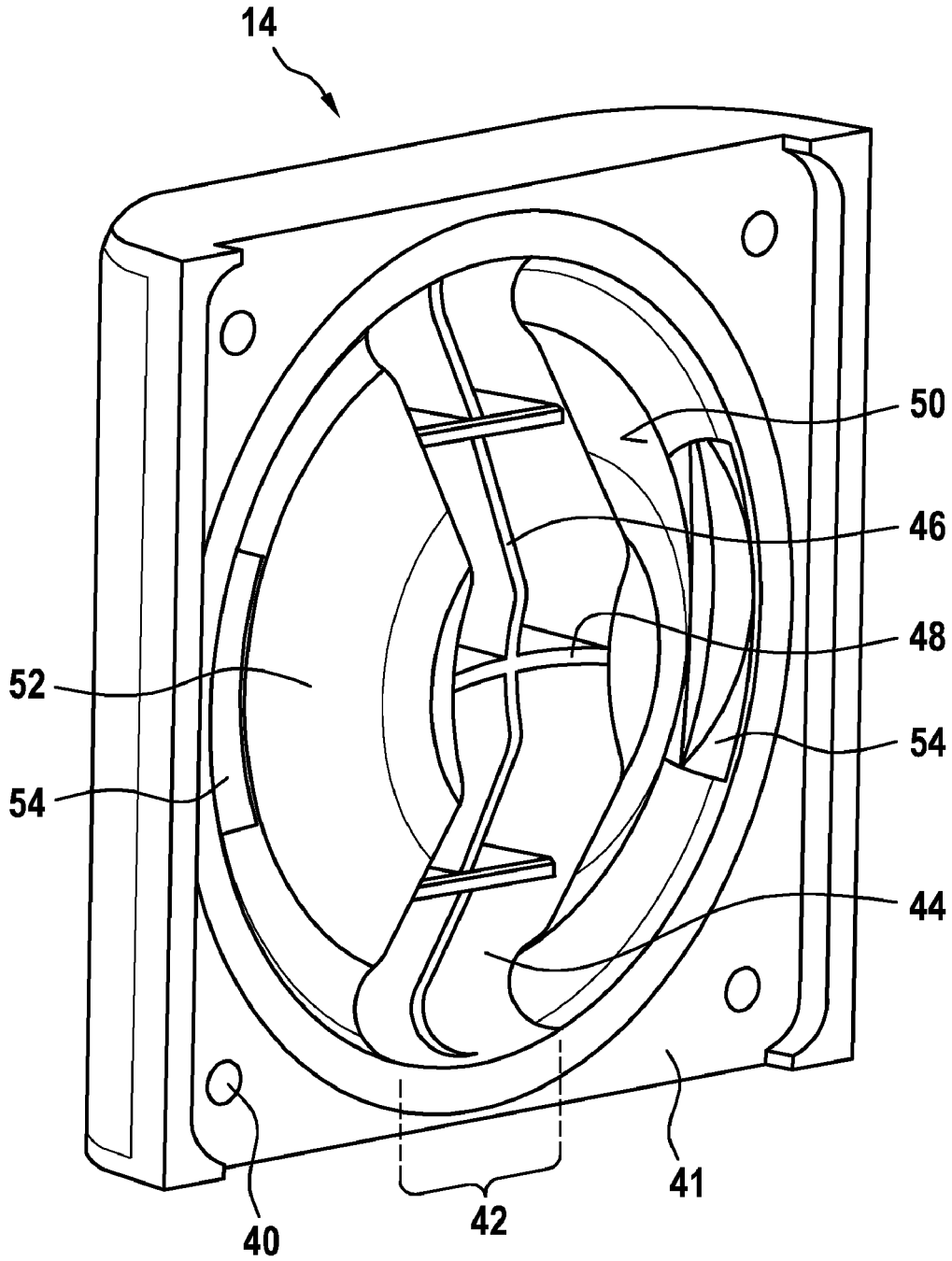
FIG. 4 shows a rear side of a sound-guiding device.

FIG. 4 shows a rear side 41 of the sound-guiding device 14. The rear side 41 has in the center of the sound-guiding device 14 a vertically running rear slot 42. The rear slot 42 is divided into individual openings for channels 44 by horizontal, rear transverse members 48 and a vertical, rear longitudinal member 46. In the preferred exemplary embodiment, the sound-guiding device has eight channels 44, which are arranged in two columns and four rows. In the preferred exemplary embodiment, the rear slot 30 has a width over the two channels 44 of 20 mm. The sound-guiding device 14 is in this case formed in such a way that a sound generated by a loudspeaker is introduced into the rear slot 42 and/or the channels 44 of the rear slot 42. For this purpose, the rear surface 50 of the rear side 41 of the sound-guiding device 14 facing the loudspeaker is formed in certain regions in the region of the loudspeaker diaphragm and the covering cap of the loudspeaker in the form of a negative impression 52 of the loudspeaker and/or of the loudspeaker diaphragm. In the preferred exemplary embodiment, the distance between the loudspeaker diaphragm and the rear surface 50 of the rear side 41 of the sound-guiding device 14 facing the loudspeaker with the sound-guiding device 14 mounted on the loudspeaker in the region of the negative impression 52 is approximately 5 mm. Furthermore, in the preferred exemplary embodiment, the two channels 44 at the top and at the bottom have a shorter sound transit time in comparison with the two middle channels 44, so that the sound generated by the loudspeaker is radiated out of the chambers of the front slot substantially in-phase. The sound transit time of the channels 44 at the top and at the bottom is 0.03 ms, while the sound transit time of the two middle channels is 0.06 ms. FIG. 4 also shows two damping elements 54, which are arranged to the right and left between the rear side 41 of the sound-guiding device 14 and the housing and/or the loudspeaker. The damping elements 54 are formed from sound-absorbing foam.

The invention claimed is:

1. A loudspeaker box (12) comprising a housing (20), a loudspeaker (22) arranged in the housing (20) for generating sound, and a sound-guiding device (14), wherein the sound-guiding device (14) is arranged in front of the loudspeaker (22) in a sound propagation direction (25), and wherein the sound-guiding device (14) is configured in such a way that the sound-guiding device (14) directs the sound generated by the loudspeaker (22) to a front slot (30) arranged on a front side (27) of the sound-guiding device (14) for the purpose of sound radiation, the front slot (30) extending in a longitudinal direction transverse to a sound propagation direction (25) of the loudspeaker box (12), wherein the loudspeaker (22) has a loudspeaker diaphragm (23), wherein the sound-guiding device (14) has a rear side (41) facing the loudspeaker (22) and having a rear surface (50), wherein the rear surface (50) is formed at least in certain regions in the form of a negative impression (52) of the loudspeaker (22) and/or of the loudspeaker diaphragm (23), wherein the rear side (41) has a rear slot (42) which is elongated in a longitudinal direction transverse to the sound propagation direction (25) and into which the sound generated by the loudspeaker (22) is introduced, and wherein the rear slot (42) is divided into individual openings by at least one rear longitudinal member (46) that extends along the longitudinal direction of the rear slot (42) and by at least one rear transverse member (48) that is transverse to the at least one rear longitudinal member (46).

2. The loudspeaker box (12) as claimed in claim 1, wherein the front slot (30) is arranged vertically.

3. The loudspeaker box (12) as claimed in claim 2, wherein the rear slot (42) extends vertically, and wherein the front slot (30) and the rear slot (42) are centrally located on the sound-guiding device (14).

4. The loudspeaker box (12) as claimed in claim 1, characterized in that the front slot (30) has a width of between 10 mm and 30 mm.

5. The loudspeaker box (12) as claimed in claim 1, characterized in that the rear surface (50) of the rear side (41) of the sound-guiding device (14) facing the loudspeaker (22) has in a region of the loudspeaker diaphragm (23) substantially a distance of less than 10 mm from the loudspeaker diaphragm (23).

6. The loudspeaker box (12) as claimed in claim 1, characterized in that the front slot (30) is divided into chambers (36) by front longitudinal and/or transverse members (32, 34), wherein each of the chambers (36) is connected by a respective channel (44) to a respective one of openings of the rear slot (42), and wherein each of the channels (44) has a predetermined sound transit time.

7. The loudspeaker box (12) as claimed in claim 6, characterized in that the predetermined sound transit time of a sound introduced into one of the channels (44) until when the sound is radiated out of one of the chambers (36) is different for at least two of the channels (44).

8. The loudspeaker box (12) as claimed in claim 6, characterized in that the predetermined sound transit times of the channels (44) are such that the sound is radiated out of the chambers (36) of the front slot (30) substantially in-phase.

9. The loudspeaker box (12) as claimed in claim 1, characterized in that at least one damping element (54) is arranged between the rear side (41) of the sound-guiding device (14) and the housing (20) and/or the loudspeaker (22).

10. The loudspeaker box (12) as claimed in claim 1, characterized in that at least one edge (38) of the front side (27) of the sound-guiding device (14) is rounded with a radius of from 5 mm to 30 mm.

11. A column loudspeaker box (10), comprising at least two loudspeaker boxes (12) as claimed in claim 1 arranged one on top of the other.

12. The column loudspeaker box (10) as claimed in claim 11, characterized in that surface normals (19) of the front sides (27) of the sound-guiding devices (14) of two loudspeaker boxes (12) arranged directly one on top of the other form an angle (21) of between 0° and 5°.

13. The column loudspeaker box (10) as claimed in claim 11, characterized in that surface normals (19) of the front sides (27) of the sound-guiding devices (14) of two loudspeaker boxes (12) arranged directly one on top of the other form an angle (21) of 1°.

14. The column loudspeaker box (10) as claimed in claim 11, characterized in that surface normals (19) of the front sides (27) of the sound-guiding devices (14) of two loudspeaker boxes (12) arranged directly one on top of the other form an angle (21) of between 0° and 10°.

15. The loudspeaker box (12) as claimed in claim 1, characterized in that the front slot (30) has a width of between 15 mm and 25 mm.

16. The loudspeaker box (12) as claimed in claim 1, characterized in that the front slot (30) has a width of 20 mm.

17. The loudspeaker box (12) as claimed in claim 1, characterized in that the rear surface (50) of the rear side (41) of the sound-guiding device (14) facing the loudspeaker (22) has in a region of the loudspeaker diaphragm (23) substantially a distance of less than 5 mm from the loudspeaker diaphragm (23).

18. The loudspeaker box (12) as claimed in claim 1, characterized in that the rear surface (50) of the rear side (41) of the sound-guiding device (14) facing the loudspeaker (22) has in a region of the loudspeaker diaphragm (23) substantially a distance of less than 2 mm from the loudspeaker diaphragm (23).

19. The loudspeaker box (12) as claimed in claim 1, characterized in that at least one edge (38) of the front side (27) of the sound-guiding device (14) is rounded with a radius of from 10 mm to 20 mm.

20. The loudspeaker box (12) as claimed in claim 1, wherein the loudspeaker diaphragm (23) has a central axis, wherein the rear surface (50) includes two portions of a cone centered on the central axis and wherein the two portions of the cone form a portion of the negative impression (52) and are located on opposite sides of the rear slot (42).

21. The loudspeaker box (12) as claimed in claim 1, wherein the at least one rear transverse member (48) includes a plurality of rear transverse members (48), wherein each of the plurality of rear transverse members (48) has opposite planar sides running parallel to the sound propagation direction (25), and wherein the at least one rear longitudinal member (46) has opposite planar sides running perpendicular to the opposite planar sides of the plurality of rear transverse members (48).

22. The loudspeaker box (12) as claimed in claim 21, wherein a center rear transverse member of the plurality of rear transverse members (48) has a concave edge that forms a portion of the negative impression (52).

23. The loudspeaker box (12) as claimed in claim 1, wherein the front slot (30) is divided into chambers (36) by front longitudinal and/or transverse members (32, 34), and wherein each of the chambers (36) is connected by a respective channel (44) to a respective one of openings of the rear slot (42).

24. The loudspeaker box (12) as claimed in claim 1, wherein the longitudinal direction of the rear slot (42) is parallel to the longitudinal direction of the front slot (30).

25. A loudspeaker box (12) comprising a housing (20), a loudspeaker (22) arranged in the housing (20) for generating sound, and a sound-guiding device (14), wherein the sound-guiding device (14) is arranged in front of the loudspeaker (22) in a sound propagation direction (25), and wherein the sound-guiding device (14) is configured in such a way that the sound-guiding device (14) directs the sound generated by the loudspeaker (22) to a front slot (30) arranged on a front side (27) of the sound-guiding device (14) for the purpose of sound radiation, wherein the front side (27) has a planar surface in which the front slot (30) is disposed and has at least one edge (38) which begins flush with the planar surface and curves only rearwardly, opposite the sound propagation direction (25), and outwardly from the planar surface, wherein the front slot (30) has a width of between 10 mm and 30 mm, and wherein the at least one edge (38) of the front side (27) of the sound-guiding device (14) is rounded with a radius of from 5 mm to 30 mm.

26. The loudspeaker box (12) as claimed in claim 25, wherein the front side (27) also has a second edge (38) which extends outwardly from the planar surface in a direction opposite that in which the at least one edge extends, wherein the second edge (38) begins flush with the planar surface and curves only rearwardly, opposite the sound propagation direction (25), and outwardly from the planar surface, and wherein the second edge (38) is rounded with a radius of from 5 mm to 30 mm.

* * * * *